US006779205B2

(12) United States Patent
Mulvey et al.

(10) Patent No.: US 6,779,205 B2
(45) Date of Patent: Aug. 24, 2004

(54) VACUUM SURGE SUPPRESSOR FOR POOL SAFETY VALVE

(76) Inventors: Kevin Mulvey, 4505 Prosperity Dr., Ft. Pierce, FL (US) 34982; George Pellington, P.O. Box 1309, Jupiter, FL (US) 33468-1309; Marwood Ruschel, 485 NW. 353 Blvd., Okeechobee, FL (US) 34972

( * ) Notice: Subject to any disclaimer, the term of this patent is extended or adjusted under 35 U.S.C. 154(b) by 0 days.

(21) Appl. No.: 10/273,059

(22) Filed: Oct. 17, 2002

(65) Prior Publication Data

US 2003/0074729 A1 Apr. 24, 2003

Related U.S. Application Data

(60) Provisional application No. 60/329,670, filed on Oct. 18, 2001.

(51) Int. Cl.[7] ..... E04H 4/00
(52) U.S. Cl. ..... 4/509; 4/504; 4/507; 4/508
(58) Field of Search ..... 4/504, 507, 508, 4/509; 138/26; 417/540

(56) References Cited

U.S. PATENT DOCUMENTS 3,741,692 A * 6/1973 Rupp ..... 417/540
5,347,664 A * 9/1994 Hamza et al. ..... 4/509
5,682,624 A * 11/1997 Ciochetti ..... 4/509
5,690,476 A * 11/1997 Miller ..... 417/44.2
6,038,712 A * 3/2000 Chalberg et al. ..... 4/507
6,227,808 B1 * 5/2001 McDonough ..... 417/44.2
6,295,661 B1 * 10/2001 Bromley ..... 4/504
6,341,387 B1 * 1/2002 Zars ..... 4/504
6,374,854 B1 * 4/2002 Acosta ..... 137/509
2002/0104158 A1 * 8/2002 Dick et al. ..... 4/504
2002/0189679 A1 * 12/2002 Avis et al. ..... 137/462

* cited by examiner

*Primary Examiner*—Amanda R. Flynn
(74) *Attorney, Agent, or Firm*—Kevin Redmond

(57) ABSTRACT

A vacuum surge suppressor for swimming pool safety valves. These valves normally sense and then instantly relieve excessively high vacuum levels in the pool's drain line. Such high vacuum levels occur when an individual becomes trapped by the suction at the pool's drain port which is connected to the drain line. The valve relieves the high vacuum level in the pool's drain line and the suction at the drain port by bleeding air into the pool's drain line, causing the pump connected to the drain line to lose prime. However, the safety function and indeed the entire function of the pool's drain system can be disabled by a short duration vacuum surge which occurs when the pump starts. The present invention suppresses the surge before it reaches the safety valve, thereby permitting the pool and the valve to function despite the presence of such short duration surges.

6 Claims, 5 Drawing Sheets

VACUUM SURGE SUPPRESSOR FOR POOL SAFETY VALVE

This application claims the benefit of Provisional application Ser. No. 60/329,670 filed Oct. 18, 2001.

BACKGROUND

1. Field

The present invention relates to pool safety valves that bleed air into the pool's drain line to relieve excessively high vacuum levels, causing the pool's pump to lose prime and more particularly to surge suppressors used to prevent the improper activation of such valves caused by high vacuum transients caused by the activation of the drain line pump.

2. Prior Art

There have been numerous cases of serious injuries and deaths caused by high vacuum levels at a pool's drain port which holds an individual to the drain port and in some cases causes disembowelment. When such an incident occurs, the vacuum level in the drain line leading from the drain port to the pool's pump rises sharply.

Various safety valves have been developed in which the high vacuum level occurring during such incidents is sensed and used to trip the valve and allow air to bleed into the drain line, causing the pump to lose prime. Although such valves function to some degree, they generally suffer from premature activation caused by the turning on of the pool's drain line pump. When this pump is turned on initially, it produces a high vacuum surge which causes the safety valve to be tripped even though no one is trapped at the drain port of the pool. This phenomenon prevents a pool drain line pump from being effective because the water in the pool is not properly circulated, filtered or cleaned.

A surge suppressor is needed to prevent transient vacuum from activating the safety valve resulting in the loss of pump effectiveness; however, for the surge suppressor to be useful, it must allow the safety valve to perform its function when the vacuum level in the drain line is not transient but persists indicating a possible emergency caused by an individual trapped at the pool's drain port.

SUMMARY

An object of the present invention is to provide a surge suppressor for a pool safety valve which will not be actuated by short duration vacuum transients.

An object of the present invention is to provide a surge suppressor which will not interfere with the normal operation of the pool safety valve.

The present invention is a vacuum surge suppressor intended for use with swimming pool safety valves. Pool safety valves normally sense and then instantly relieve excessively high vacuum levels in the pool's drain line. Such high vacuum levels occur when an individual becomes trapped by the suction at the pool's drain port which is connected to the drain line. The valve relieves the high vacuum level in the pool's drain line and the suction at the drain port by bleeding air into the pool's drain line, causing the pump connected to the drain line to lose prime. However, the safety function and indeed the entire function of the pool's filtration system can be disabled by a short duration vacuum surge in the drain line which occurs when the pump starts. The present invention suppresses the surge before it reaches the safety valve, thereby permitting the pool and the valve to function normally despite the presence of such short duration surges.

The surge suppressor is connected between the pool's drain line and the safety valve. In this location, the surge suppressor attenuates transients in the vacuum level in the drain line before they reach the safety valve to prevent them activating the safety valve. However, a sustained high vacuum level will pass through the suppressor and activate the valve allowing it to function normally and protect personnel using the pool.

The surge suppressor is essentially a vessel having an appreciated volume of typically 170 cubic inches; however, it is connected to the drain line through a small orifice which can typically have a diameter of one-eighth of an inch. When a surge is received, it tends to drain air out of the chamber through the small orifice, which limits the rate at which the air can leave the vessel. The transient can be over in less than a second, and results in only a small volume of air being withdrawn from the vessel which presents only a slightly lower pressure to the valve, preventing it from being activated by the transient.

When a long duration, high vacuum level is introduced, the sustained reduction in pressure continues to draw air from the vessel until the vacuum level in the vessel is the same as in the drain line. The safety valve is connected to the vessel at a point away from the orifice, allowing a high vacuum level in the vessel to be transmitted through the vessel to the safety valve to activate the valve.

DETAILED DESCRIPTION OF THE INVENTION

Figure 1:
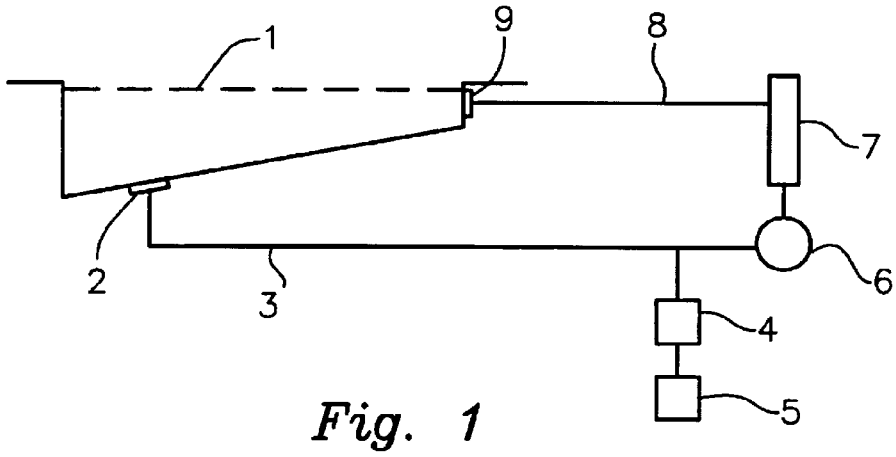
FIG. 1 is a schematic diagram of a pool, and its filtration system including the pool's drain line, pump, filter, surge suppressor safety valve.

FIG. 1 is a schematic of a pool 1 along with its filtration and safety systems, which include the pool's inlet line 8, drain line 3, pump 6, filter 7, surge suppressor 4, and safety valve 5. The pool itself includes a drain port 2 and an inlet port 9. The drain port is connected to the intake of the pump by means of the drain line, while the output of the pump is returned to the pool by way of the filter, inlet line and inlet port. The water in the pool is drawn out of the pool through the drain port and the drain line by the vacuum produced by the pump. The water coming from the output of the pump is passed through the filter to remove small particles and other contamination. The water from the filter output is returned to the pool through the inlet line and inlet port.

A safety valve 5 is connected to the drain line by way of a surge suppressor 4. The safety valve is designed to be tripped when the vacuum in the drain line exceeds a predetermined level. This predetermined vacuum level normally corresponds to the vacuum level that occurs when a victim is trapped by the suction at the drain port. When the safety valve is tripped, it bleeds air into the drain line, causing the pump to lose prime and reduce the vacuum level in the drain line to near zero to free the victim at the drain port.

The safety valve works well and it can save lives. Unfortunately, it is often disabled or removed by the pool owners because the vacuum surge produced by the pump when it starts causes the safety valve to be tripped. Once the valve has been tripped in this manner, it cavities the pump. This can occur every time the pump starts, which effectively prevents the pool water from being filtered.

To overcome this problem, the surge suppressor has been developed. The surge suppressor prevents the presence of a short term, high vacuum surge, that is typically less than a second long, from tripping the safety valve, while permitting the valve to function normally when a vacuum level exceeding the predetermined level is sustained for a period of typically a second or more. The surge suppressor can be designed to handle longer or shorter pulses to accommodate the conditions at a particular pool.

Figure 3:
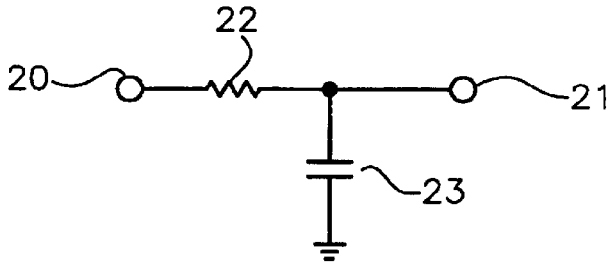
FIG. 3 is a electrical equivalent circuit of the surge suppressor comprising a series resistor and a shunt capacitor.
Figure 4A:
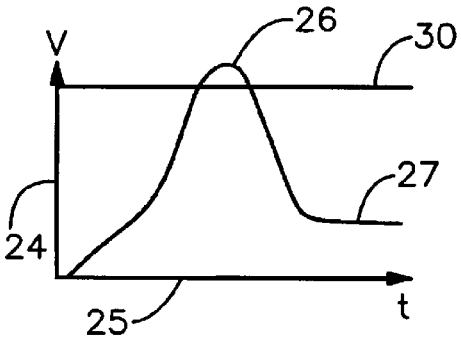
FIG. 4A is a diagram of the equivalent electrical input waveforms to the circuit of FIG. 3.
Figure 4B:
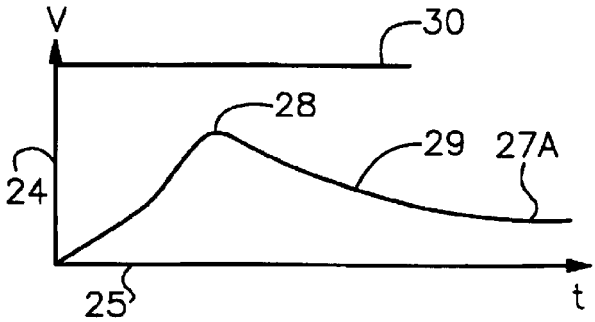
FIG. 4B is a diagram of the equivalent electrical output waveform from the circuit of FIG. 3.

The operation of the surge suppressor can be explained with the aid of electrical analogs in which the vacuum level as a function of time is represented by a voltage waveform and the surge suppressor is represented by an electrical circuit. This is done in FIGS. 3, 4A, and 4B. FIG. 3 shows an electrical circuit which represents the surge suppressor, while FIGS. 4A and 4B show electrical waveforms that represent the vacuum levels entering and leaving the surge suppressor. FIG. 3 comprises an input port 20, a series resistor 22, a shunt capacitor 23 and an output port 21. The resistor is connected between the input and output ports. The capacitor is connected between the output port and ground.

FIG. 4 is a graph of the input wave from to the surge suppressor. The vertical axis 24 is the voltage amplitude and corresponds to the vacuum level in the drain line. The horizontal axis 25 represents time. The waveform in FIG. 4A starts out at zero and then builds to a peak voltage 26 before dropping back to a lower level 27. This waveform represents the vacuum level in the drain line when the pump is first started. There is at first no vacuum and there is a peak transient surge in the vacuum level before the vacuum level drops back to a normal operating level. A line 30 is drawn horizontally across the graph below the peak voltage 26. This line corresponds to the predetermined vacuum level at which the safety valve will be tripped. Since the peak exceeds the trip level, the transient produced by the pump on starting will trip the safety valve.

However, if the surge suppressor is placed between the valve and the drain line, the valve will see a different waveform such as that shown in FIG. 4B in which the waveform has a peak voltage 28 which falls below the predetermined trip level 30. This waveform will not trip the safety valve. The waveform in FIG. 4B which does not have a peak that exceeds the trip level of the safety valve was derived from the waveform in FIG. 4A which would have tripped the safety valve, but was modified by the surge suppressor to eliminate the short term peak vacuum level that occurred at the peak 26.

The reduction in the short term peak can be accomplished by the circuit shown in FIG. 3. Initially at zero time the capacitor 23 acts as a short and the input voltage is dropped across the resistor 22 providing no output at time zero. The capacitor is charged and the voltage rises, but this charging process takes time. The result is the voltage across the capacitor never reaches the peak voltage 26 because the input voltage drops off from its peak value before the voltage across the capacitor has a chance to reach this peak voltage. The R-C time constant produced by the resistor 22 and the capacitor 23 does not allow the voltage on the capacitor to follow sharp peak in voltage. It tends to smooth them out.

However, the capacitor can follow slower rises in voltages and can reach a sustained voltage. This means that if there was a constant voltage level applied to the input of the circuit of FIG. 3, the output voltage would eventually rise to that level. This corresponds to the case where a high vacuum level to the safety valve trips the valve, after a short delay. The ability of the surge suppressor to eliminate peak surges while delivering sustained vacuum levels allows the safety valve to avoid being tripped by surges, while functioning normally by being tripped by sustained high vacuum levels.

Figure 2A:
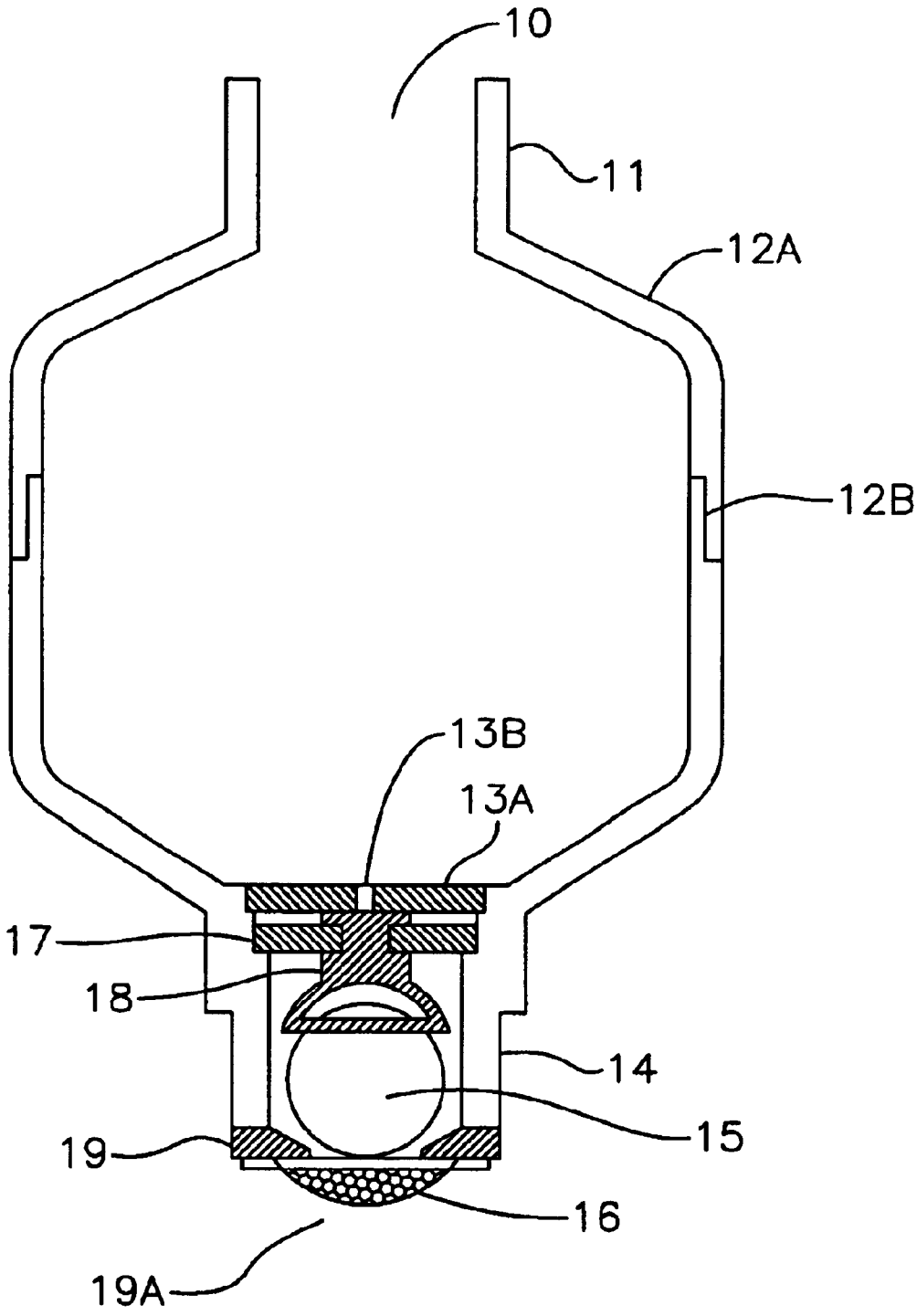
FIG. 2A is a cross sectional diagram of a first surge suppressor system embodying the present invention.

FIG. 2A shows a cross sectional view of surge suppressor comprising a first port 10, a first neck 11, a chamber 12A, a junction in the chamber 12B, an orifice disc 13A, an orifice 13B in the orifice disc, a second neck 14, a ball float 15, a debris screen 16, a seal disc 17, a float check seal 18, a float stop 19 and a second port 19A in the float stop 19.

The chamber 12A is a vessel having relative large cross section which is necked down at its top and bottom. The necked downed portions containing openings to the chamber. The upper neck is the first neck 11, while the lower neck is the second neck 14. The opening at the top is the first port 10, while the opening in the bottom is the second port 19A. The chamber is fabricated in two portions which are joined at a junction 12B. Within the second neck, located one above the other, are the debris screen 16, the float stop 19, the ball float 15, the float check seal 18, the seal disc 17 and the orifice 13A. The first port is connected to the safety valve while the second port is connected to the drain line.

The operation of the surge suppressor shown in FIG. 2A is analogous to the operation the electrical circuit shown in FIG. 3 discussed above. The first and second port of the suppressor correspond to the input an output of the electrical circuit. The resistor corresponds to the orifice, while the chamber corresponds to the capacitor. The orifice is relatively small compared to the cross section of the chamber. It offers resistance to the air flowing through it and thereby slows the rise of the vacuum level in the chamber due to fast transient peaks in the vacuum level in the drain line, while at the same time allowing the chamber to reach the level of a sustained vacuum in the drain line after a delay. This prevents the safety valve from being tripped by a surge while permitting it to respond to a sustained high vacuum level such as that produced by a victim trapped at the drain port of the pool. That sustained vacuum level is referred to as the first predetermined vacuum level and it is the level which opens the safety valve.

The debris screen is to prevent debris in the drain line from entering the surge suppressor and blocking the orifice. The ball float floats upward into the float check seal closing off the second port to the drain line to prevent any water in the drain line from entering the chamber. The float stop supports the ball float when there is no water in the second port. The orifice disc closes off the second port, except for the orifice contained in this disc.

The present invention has been designed to solve a serious problem with currently available safety valves that has been plaguing the use of the potentially life saving devices. It has been successfully tested and now makes the safety valve a viable device.

It is understood that once disclosed, those skilled in the art may devise many equivalents that fall within the spirit and scope of the present invention. Such equivalents include chambers and orifices of various shapes and sizes. The amount of surge suppression is determined by the ratio of the orifice cross section to the capacity of the tank. A range of values is suitable in many instances, the only measurable difference being the length of delay to the response, which is short in most cases, allowing appreciable flexibility in this area.

The surge suppressor is usually connected to the drain line by a length of pipe which typically extends above the drain line. If the separation between the drain line and the suppressor is appreciable, there is little chance that water will reach the surge suppressor and if it does, it can be expected to drain back down into the drain line. In such cases, a lower cost unit may be made eliminating the debris screen the ball float, stop and check seal.

Figure 2B:
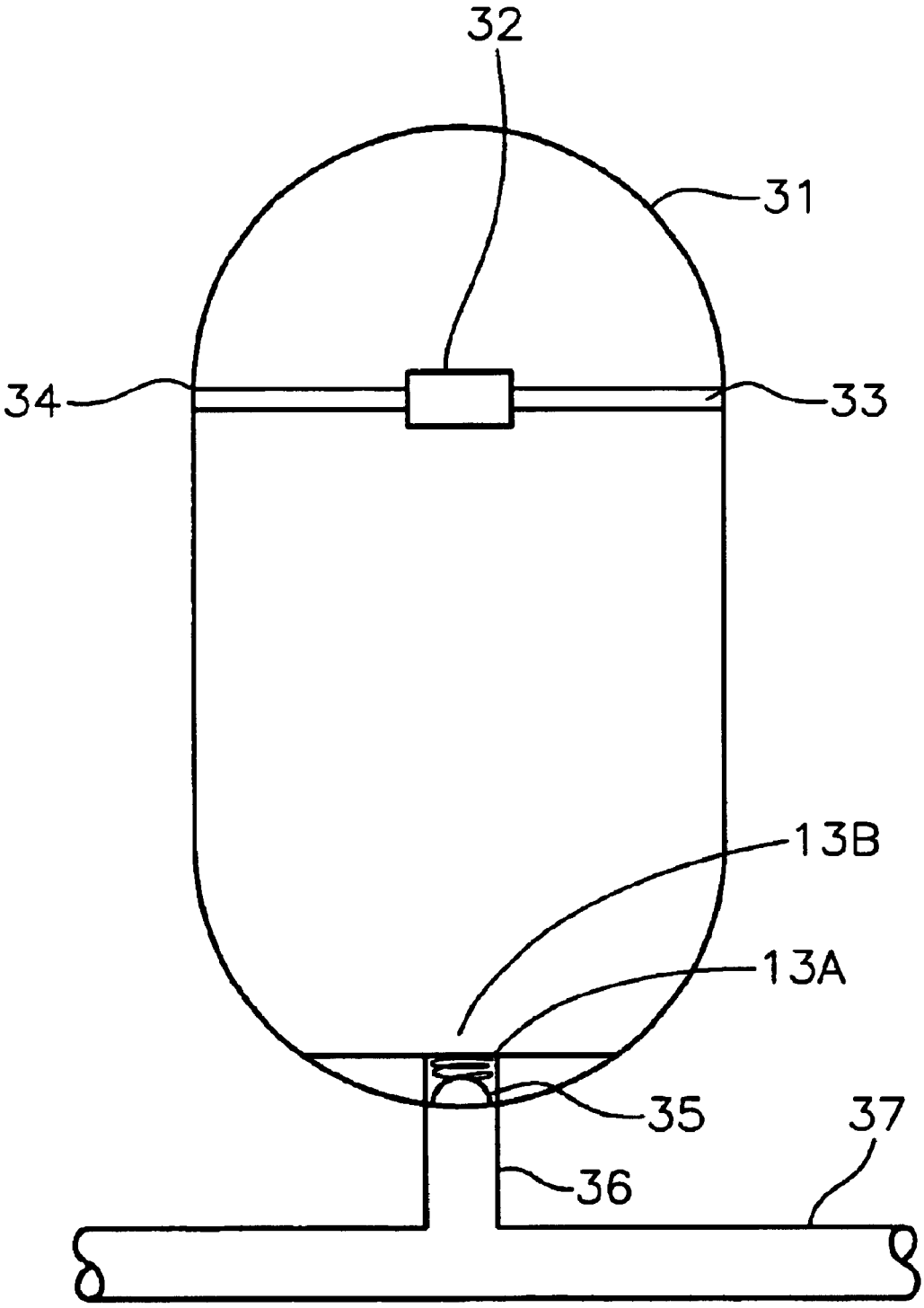
FIG. 2B is a cross sectional diagram of a second surge suppressor system embodying the present invention and including the surge suppression valve in the surge suppressor tank.

FIG. 2B is a cross sectional diagram of a second surge suppressor embodying the present invention. It includes a second vacuum suppressor vessel 31, a vacuum safety valve 32, a vent 33 for the safety valve, an access port 34 for a screw driver to disc 13A, an orifice 13B in the disc 13A, a spring loaded poppet valve 35, and a line 36 connecting the vessel or tank 31 to a drain line 37. The vessel of FIG. 2B has the vacuum safety valve combined with the vessel as a single unit. In FIG. 2B the valve is installed in the upper area inside the vessel, providing the user with a single item for installation rather than two items. The safety valve has an input port to accept air and an output port to release air. The safety valve needs no connection from its output port to the vessel because it is enclosed inside the vessel. The valve's input port receives air through an air tight line 31 which connects the input port to the outside of the tank and provides outside air to the valve as required.

The valve also has an air tight access port 34 which provides screw driver access to valve to set the valves vacuum trip level at which point the valve allows air to pass through it.

The ball float 15 in FIG. 2A is replaced by a spring loaded poppet valve 35, simplifying and reducing the cost of the design shown in FIG. 2B. The lower portion of the tank is connected to a line 36 which is connected to the drain line 37. The operation of this unit is the same as the surge suppressor shown in FIG. 2A, but has the advantage of being lower in overall cost and simpler to install because the suppressor and safety valve are now contained in a single unit.

The surge suppressor can be designed to accommodate the type and length of surge found at a particular site by varying the size of orifice or the size of the chamber. The orifice is the easiest to vary, as it can be done by means of a set screw which is threaded into the orifice to reduce its size.

Figure 2D:
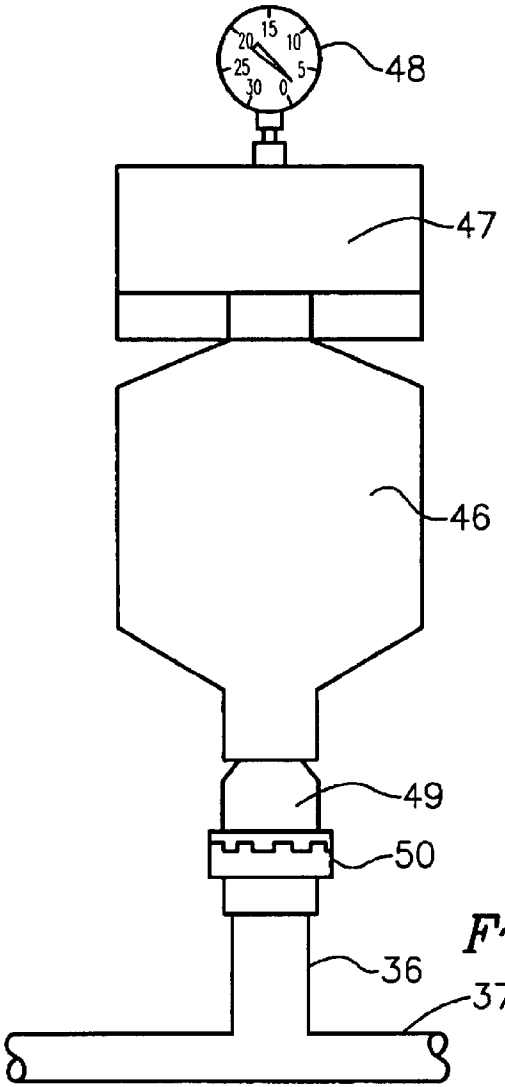
FIG. 2D is a side view of a third surge suppressor system embodying the present invention and including a check valve to permit air to recharge the suppressor tank.
Figure 2C:
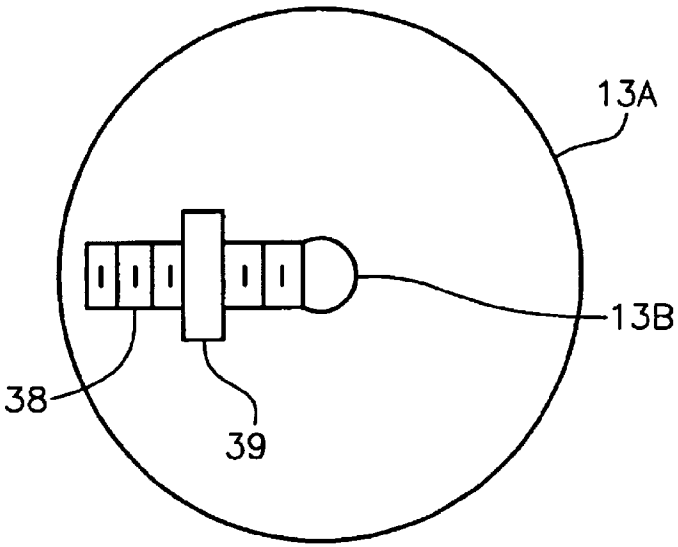
FIG. 2C is a plan view of an orifice plate showing an adjustment screw used to adjust the effective size of the orifice.

This arrangement is shown in FIG. 2C where an orifice disc 13B carrying an orifice 13 is adjusted in effective size by threading a screw 38 into the orifice. The screw 38 is threaded through a nut 39 which is attached to the disc 13A.

FIG. 2D is a third surge suppressor system which includes a pressure gage 48, a second vacuum safety valve 47, a second vacuum suppressor vessel 46, an upper housing for a suppressor release valve (SRV) 49, a lower housing for the SRV 50, a line connection 36 from the SRV to the drain line 37.

In the operation of the systems shown in FIG. 2D, a sudden surge in vacuum level produced in the drain line 37 by starting the pump will draw open the SRV and allow air from the vacuum suppressor tank 46 to be taken into the line 36 to relieve the sudden surge in vacuum pressure and prevent the vacuum safety valve 47 from opening on this type of short surge. Once the surge has passed, the SRV will allow the air in the line 36 to be drawn back into the vacuum suppressor tank 46 to recharge the tank for the next cycle.

In the case where a sustained vacuum level above the first predetermined level is maintained in the drain line 37 due to a victim being trapped at a pool drain, then the sustained vacuum level will be transmitted through an open SRV and the vacuum suppressor vessel to the vacuum safety valve 47. The SRV opens at a second predetermined vacuum level which is lower than the first predetermined vacuum level. When the higher first predetermined level is reached in the drain line, then both the safety valve and the SRV open.

A sustained vacuum level exceeding the first predetermined level will open the safety valve. The open valve will allow air to pass through the safety valve, the vacuum suppressor tank and the SRV into the drain line, causing the pump to start to lose prime. Once the pump has started to lose prime, the vacuum level in the drain line is reduced below the second predetermined level. The SRV then closes and allows the vacuum level in the drain line to build up again. The time for this cycle of change in the vacuum level to take place is sufficient to release any victim from a pool drain port. Once the vacuum level in the drain line 37 has built up sufficiently, it again opens the SRV and the cycle repeats. When the pump almost loses prime again, the SRV closes, allowing water to flow through the drain line. This cycling, between almost losing prime and regaining it, not only allows a victims to escape from a pool drain, but at the same time allows sufficient water to pass through the pump to prevent the pump from sustaining damage due to running without water.

Figure 2F:
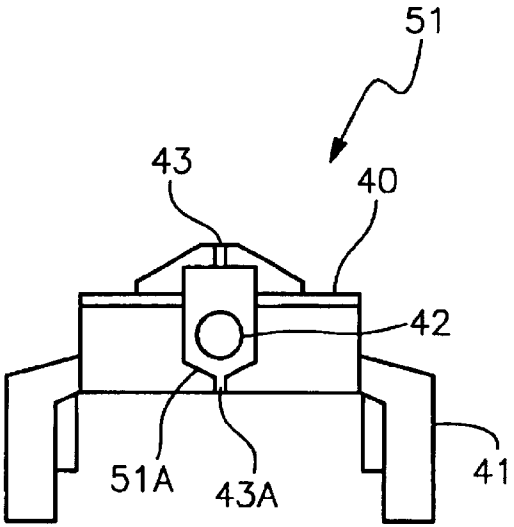
FIG. 2F is a cross sectional view of the plug for the suppressor release valve system shown in FIG. 2E.
Figure 2E:
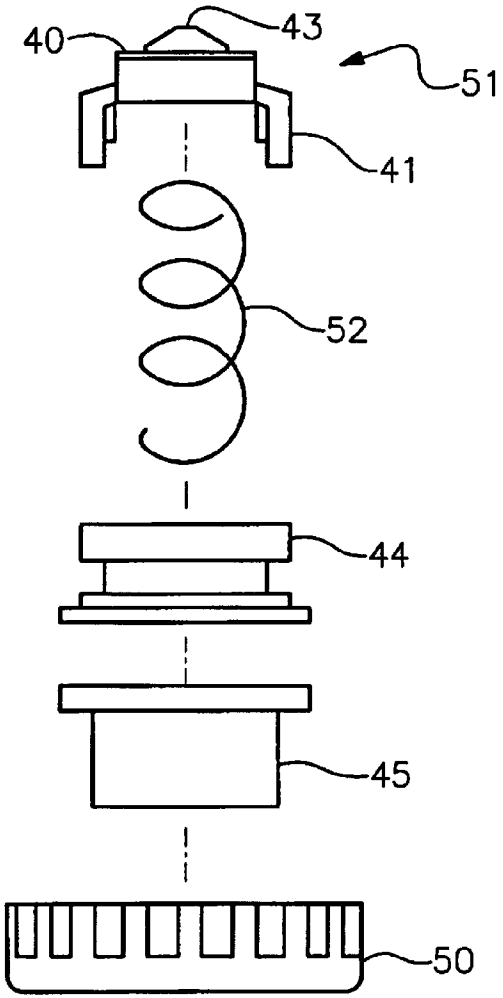
FIG. 2E is a side view of the components of the suppressor release valve used in the system of FIG. 2D.

FIG. 2E shows the components contained within the SRV housing. These components include a plug 51, a spring 52 for the plug, legs such as leg 41 on the plug to grip the upper end of the spring, a hole 43 on the top of the plug, a lower retainer 44 for the SRV spring, a connection fitting 45 to make connection to the outside line 36.

The parts of the SRV shown in FIG. 2E are located one above the other in the same relative location that they are assembled in SRV housing. The component on top in this Figure is the plug 38 which rests on the spring 52. Below the spring is the spring retainer 44 which rests on the lower SRV housing 50. The plug 38 is pressed against the inside of the upper SRV housing 49 by the spring, closing the passage from the inside of the vacuum suppressor vessel 46 to the drain line 37. However, when a vacuum level exceeding the second predetermined level appears in the drain line 37, it draws the SRV downward and releases air from the suppressor vessel by permitting it to pass through the SRV. The vacuum level to activate the SRV (which is also referred to as the second predetermined level) is determined by the spring pressure and that is chosen to be below the first predetermined level to allow the SRV to function with the pressures found in the drain line for sustained drain blockage. When the vacuum in the drain line drops below the second predetermined level, as it does after pump loses prime, the SRV is pushed up again by the spring to close off this airway to the vessel 46.

FIG. 2F is a cross sectional view of the plug 51 showing a first opening 43 in the top of the plug and a second opening 43A in the bottom of the plug. These are relatively small openings being approximately 1/16" in diameter. When the SRV is closed, the air contained in line 36 can be drawn back into the suppressor vessel 46 by way of these openings to recharge the vessel. There is a small ball 42, typically made of solid metal, that functions with hole 43A to provide a check valve which prevents air in the vessel from leaking out through hole 43A when the SRV is closed.

This metal ball sits over the bottom opening 43A in the plug. The bottom of the inside of the plug 51A is conically shaped with the apex of the core being colocated hole 43A. The weight of the ball normally keeps it at the bottom of the conically shaped surface and pressed down over the hole 43A to block air flow. However, when the pressure in the suppressor vessel 46 is lower than that in the line 36, the ball 42 is forced to rise upward, allowing air to pass from line 36 through the lower hole 43A and the upper hole 43 into the suppressor vessel to recharge it.

Having described our invention, we claim:

1. A surge suppression system for a pool safety valve which includes a pool safety valve, surge suppressor, a drain, a drain line and a pump, said drain line being connected between said drain and said pump and said pool safety valve being connected to said drain line to open and stay open to bleed air into said drain line when the vacuum level in said drain line exceeds a first predetermined value causing said pump to lose prime, said surge suppressor comprising a vessel enclosing a volume of air, said vessel having a first and a second opening, said first opening being connected to said pool safety valve, said second opening being connected to said drain line and said vessel forming an air passage from said safety valve through said vessel to said drain line to permit air bled from said safety valve to reach said drain line, said second opening in said vessel containing means for constricting the flow of air from said vessel to said drain line.

2. A surge suppression system as claimed in claim 1 wherein said means for constricting the flow is an orifice.

3. A surge suppression system as claimed in claim 2 wherein said orifice is adjustable in size.

4. A surge suppression system as claimed in claim 3 wherein said orifice is formed in a first plate mounted across said second opening.

5. A surge suppression system as claimed in claim 4 wherein said first plate may be selected from a plurality of plates in which each plate contains a different sized orifice, said orifice for said surge suppressor being adjusted by installing one of said plurality of plates in said second opening in said vessel.

6. A surge suppression system as claimed in claim 1 further comprising a ball valve located in said second opening to allow air to pass through said second opening and prevent water from said drain line from entering said vessel.

* * * * *